US010192439B2

(12) United States Patent
Meijer et al.

(10) Patent No.: US 10,192,439 B2
(45) Date of Patent: Jan. 29, 2019

(54) METHOD FOR ESTIMATING THE OCCUPANCY OF A PARKING LOT

(71) Applicant: TomTom International B.V., Amsterdam (NL)

(72) Inventors: Arnold Mark Meijer, Amsterdam (NL); Konstantin Ermakov, Haarlem (NL)

(73) Assignee: TOMTOM INTERNATIONAL B.V., Amsterdam (NL)

( * ) Notice: Subject to any disclaimer, the term of this patent is extended or adjusted under 35 U.S.C. 154(b) by 20 days.

(21) Appl. No.: 15/521,617

(22) PCT Filed: Nov. 6, 2015

(86) PCT No.: PCT/EP2015/075979
§ 371 (c)(1),
(2) Date: Apr. 25, 2017

(87) PCT Pub. No.: WO2016/071512
PCT Pub. Date: May 12, 2016

(65) Prior Publication Data

US 2017/0243488 A1 Aug. 24, 2017

(30) Foreign Application Priority Data

Nov. 6, 2014 (GB) ..... 1419807.1

(51) Int. Cl.
*G08G 1/01* (2006.01)
*G07B 15/02* (2011.01)
(Continued)

(52) U.S. Cl.
CPC ..... *G08G 1/144* (2013.01); *G08G 1/012* (2013.01); *G08G 1/0112* (2013.01);
(Continued)

(58) Field of Classification Search
CPC ..... G08B 1/44
See application file for complete search history.

(56) References Cited

U.S. PATENT DOCUMENTS 8,063,797 B1 * 11/2011 Sonnabend ..... G06K 9/00791 340/932.2
8,423,275 B1 4/2013 Skobbler
(Continued)

FOREIGN PATENT DOCUMENTS

JP 2013-210706 A * 10/2013 ..... B60Q 1/48
JP 2013210706 A 10/2013

OTHER PUBLICATIONS

International Search Report dated Feb. 24, 2016for application No. PCT/EP2015/075979.
(Continued)

*Primary Examiner* — Joseph H Feild
*Assistant Examiner* — Pameshanand Mahase

(57) ABSTRACT

A method for estimating the occupancy of a parking lot is provided wherein map data, indicating the geometry of a parking lot, is obtained. A number of parking regions within said parking lot is then determined using said map data. A model of the spatial distribution of occupied parking regions is then generated as a function of the total number of occupied parking regions within the lot. The method further comprises receiving probe data from a plurality of portable devices within said parking lot, wherein said probe data indicates the position of each device. The probe data is analyzed in accordance with said model and an estimate of the occupancy of the parking lot is output.

19 Claims, 6 Drawing Sheets

(51) Int. Cl.
*G08G 1/14* (2006.01)
*G08G 1/04* (2006.01)

(52) U.S. Cl.
CPC ..... *G08G 1/0116* (2013.01); *G08G 1/0129* (2013.01); *G08G 1/0141* (2013.01); *G08G 1/04* (2013.01); *G08G 1/146* (2013.01)

(56) References Cited

U.S. PATENT DOCUMENTS

| | | | | |
|---|---|---|---|---|
| 2011/0117933 | A1* | 5/2011 | Andersson | G01C 21/3626 455/456.2 |
| 2011/0153208 | A1* | 6/2011 | Kruglick | G01C 21/20 701/533 |
| 2013/0257632 | A1* | 10/2013 | Harber | G08G 1/0112 340/932.2 |
| 2014/0058711 | A1 | 2/2014 | Scofield | |
| 2014/0266800 | A1 | 9/2014 | Koukoumidis et al. | |

OTHER PUBLICATIONS

Search Report dated Mar. 23, 2015 for GB Application No. 1419807.1.

* cited by examiner

METHOD FOR ESTIMATING THE OCCUPANCY OF A PARKING LOT

CROSS-REFERENCE TO RELATED APPLICATIONS

The present application is a National Stage of International Application No. PCT/EP2015/075979, filed on Nov. 6, 2015, and designating the United States, which claims benefit to United Kingdom Patent Application 1419807.1 filed on Nov. 6, 2014. The entire content of these applications is incorporated herein by reference.

FIELD OF THE INVENTION

The present invention relates to a method for estimating the occupancy of a parking lot based on probe data received from a plurality of devices within a parking lot.

BACKGROUND TO THE INVENTION

It has long been desirable to provide drivers with occupancy data concerning parking lots in order to assist them in finding an available parking space as quickly and conveniently as possible. Traditionally this has been achieved by installing physical apparatus such as cameras, parking kiosks, road sensors or entry and exit barriers at the parking lots. Information collected using this apparatus may then be electronically communicated to display boards distributed throughout a city or potentially uploaded to a server for users to access remotely via a portable device connected to the Internet.

Whilst this method has the advantages that the data provided is live and is reasonably accurate, the apparatus required to generate the occupancy data is typically expensive to install and for this reason is not always provided. Indeed this is typically the case where parking is provided free of charge, for example outside large supermarkets or retail parks. It would be desirable, however, for interested parties including retailers to still be able to monitor how busy their parking lot is so that they can take appropriate steps such as expanding their parking lot if necessary in order to attract more customers during busy periods or provide for shared use with other organisations during low occupancy periods. Furthermore, even if occupancy data is generated, this information may be kept private for the benefit of the owner of the parking lot only and not widely distributed. It would nonetheless be useful for retailers to be able to monitor the occupancy of a competitor's parking lot during different months of the year or times of day, for example, in order to estimate how busy their store is.

More recently it has been suggested that parking occupancy data could be generated by portable devices that emit "probe data" indicating the position of the device at a given point in time. For instance, a server may collect probe data from within a parking area via a mobile telephone network and compare this to an estimated fraction of vehicles equipped with a Portable navigation device (PND), to produce an estimate of the number of available parking spaces. An estimate of the average number of PNDs per vehicle can be obtained, for example, by monitoring probe data received from traffic jams across a known stretch of road containing a known number of vehicles. This can then be used to estimate the number of occupied parking spaces within a parking lot. The occupancy data generated by this method is typically unreliable however as the number of vehicles that contain a device actively emitting probe data within the lot typically deviates significantly from the assumed average. It is thus desirable to provide an improved method that overcomes the abovementioned deficiencies in the prior art.

SUMMARY OF THE INVENTION

In accordance with a first aspect of the invention there is provided a method for estimating the occupancy of a parking lot comprising:

obtaining map data indicating the geometry of a parking lot;

determining a number of parking regions within said parking lot using said map data;

generating a model of the spatial distribution of occupied parking regions as a function of the total number of occupied parking regions within the parking lot;

receiving probe data from a plurality of portable devices within said parking lot, wherein said probe data indicates the position of each device; and analysing said probe data in accordance with said model and outputting an estimate of the occupancy of the parking lot.

A method is provided for monitoring how occupied a parking lot is over a period of time for which probe data is received (the probe data typically including time stamps in that period), without the need for physical sensors (such as cameras, road sensors, entry/exit barriers or parking kiosks) to be installed at the parking lot. Occupancy data is instead generated from probe data received from portable devices, such as smartphones or portable navigation devices (PNDs), whilst map data is obtained, for example, from satellite imagery. As well as reducing the cost of generating occupancy data, this method also allows for occupancy data to be generated remotely by appropriate apparatus. The information generated can provide real time estimates of the number of occupied or available parking spaces that could be relayed to a driver using a PND. Alternatively it could be analysed to identify historic trends in the lot usage. This historic information could be particularly valuable to a lot owner, or potentially their competitor.

Not every vehicle that occupies a parking space will necessarily contain a device configured to emit probe data. Furthermore, in instances where there are multiple passengers in a vehicle, each carrying a device such as a mobile telephone configured to emit probe data, there will be a plurality of devices per vehicle. A simplistic approach would be to account for these factors by collating probe data, assume an average number of devices per vehicle and determine the occupancy of the lot accordingly. A more sophisticated approach is herein described however that accounts for the fact that drivers will tend to park their vehicles in certain areas according to particular arrangements which generally depend on the total number of occupied parking spaces, and the layout of the parking lot itself. For example, drivers will typically prefer to park their vehicles as close as possible to the exit point of a parking lot. This pattern can be predicted by generating a model which can later be applied to sample probe data in order to output a more statistically accurate estimate for the total occupancy of the parking lot than would otherwise be available.

The model preferably provides an estimate of which parking regions will be occupied as the overall occupancy of the parking lot changes. The model may, for example, predict certain preferred parking regions that are most likely to become occupied first (i.e. at the lowest level of parking lot occupation), and further anticipate an overall flow direction of how the parking lot will fill up from that point (i.e.

which regions will become occupied next) due to an influx of vehicles into the lot, or conversely how the lot will empty as previously parked vehicles exit the lot.

In order to generate an appropriate model for determining the parking behaviour of drivers using a parking lot, it is preferable that the model is based on probe data collected over a modelling period. This enables certain preferred parking locations to be empirically identified. For example it may become clear that there are multiple locations at which parked cars will tend to cluster, depending on the number of vehicles occupying the parking lot. These preferred parking locations may not be readily identifiable from the map data alone and so it is useful to generate the model according to probe data collected over a modelling period for that specific lot. By monitoring the geographical spread of occupied parking spaces at different levels of overall occupation, a model of the spatial distribution of occupied parking regions can be generated as a function of the total number of occupied parking regions within the lot. This model may include defining modelled regions, each of assumed (high or total) vehicle occupancy in the parking lot, the modelled regions being of different sizes in accordance with the total occupancy of the parking lot.

Alternatively, or in addition to the above, the model may be generated based on the geometry of the parking lot and a reference location obtained from the map data, wherein the reference location indicates a preferred parking area. For example, in the event that the map data indicates that the parking lot has a standard or common layout, an appropriate model may be chosen from one or more generic models that could be provided, without the need to actually monitor probe data received from that lot over a modelling period. Optionally, one or more reference locations identified from the map data could be inputted to this model to improve the accuracy. Alternatively, a generic model may initially be chosen based on the map data alone, and then improved upon using probe data collected over a modelling period.

The reference location may be a parking region that is most likely to be occupied; however alternatively it may not correspond directly to a parking region at all and may instead represent a position or locus of positions, located either inside or outside of the lot, the closest parking region(s) to which exhibit preferable occupancy. The reference location therefore preferably defines a preferred parking area, typically in terms of the one or more parking regions which are closest to the reference location. Such regions may therefore collectively define geometric shapes such as a linear array of regions or they may take an appropriate shape so as to surround the reference location.

Once the model has been generated it can then be applied to different probe data, such as new probe data representing in principle any relevant historical instant in time or time period. Such a time may be the present time, that is "real time". Analysing the probe data in accordance with the model preferably comprises: determining which regions of the parking lot are occupied based on the spatial density of probe data corresponding to a sampling period; and estimating the total occupancy of the parking lot based on the spatial distribution of occupied regions. Data that is 'corresponding to the sampling period' preferably indicates a moment in time that is within the sampling period, and may include data that is sent or received during that sampling period. Whilst the probe data typically includes a time stamp indicating the time at which the GPS position was evaluated, this could also potentially include time delayed signals where the probe data indicates the position of a device at a moment in time that is within the sampling period, but the data itself is sent or received outside of this period.

A particular benefit is realised wherein said probe data comprises time-stamped positional coordinates and wherein a region is determined to be occupied if the number of such coordinates received from within said region with time stamps corresponding to a parking period exceed a threshold number. For example, a device emitting probe data every ten seconds should emit three signals comprising positional coordinates within a thirty second parking period and thus a threshold number which indicated that the device was stationary (or at least remained within the parking region) during the parking period could be set at three. This would preferably indicate that a parking event has occurred and that the region is now occupied. Where such a parking event has been monitored during the sampling period for a given region, that region may preferably be assumed to remain occupied for the duration of the sampling period. It is not necessary to distinguish between probe data emitted by different devices, so long as a threshold number of coordinates have been received for a given region, or in other words, a threshold spatial density of probe data has been monitored. In principle with a view to increasing the accuracy of the model, it may be possible to include a consideration of whether each such signal is from the same or from different devices. This may be the case even though anonymising requirements for the data may prevent actual identification of the individual originating device itself.

The area of the parking lot may be divided into multiple parking regions. The size and geometry of such regions may be chosen depending on the specific application and data available. The parking regions may correspond to the location of one or more parking spaces, however most preferably each region corresponds to a single or respective parking space. Typically each parking region matches a corresponding parking space (in terms of shape, size, position and orientation). The location and geometry or perimeter of each parking space could be identified either manually or automatically by identifying the painted lane or parking space markers from the map data. Alternatively the location of each region may be approximated based on the average area of a parking space, for example. Larger regions that extend over a plurality of parking spaces may be desired where there is the average number of devices in each vehicle is particularly low, in order to increase the likelihood of obtaining probe data from within that region. It may still be necessary to later calculate or identify the number of parking spaces within the lot using the map data in order to estimate the total number of occupied or available parking spaces. As will be appreciated, not all areas of a parking lot are designated parking spaces and therefore the model may define multiple parking regions which are arranged collectively as a group in a space-filling continuous manner. Multiple groups of parking regions may be distributed through the parking lot, separated by regions which may not be used for parking, typically since these represent internal vehicle flow lanes within the parking lot.

Estimating the total occupancy of the parking lot based on the spatial distribution of occupied regions preferably further comprises generating a modelled region in which the spatial distribution of occupied regions analysed in accordance with the model indicate that the modelled region is occupied; and estimating the occupancy of the parking lot based on the number of parking regions within said modelled region. Information generated from the model, combined with probe data that has been analysed, can preferably be used to define the boundaries of the modelled region. This modelled region may typically include the majority of parking regions identified as being occupied according to the probe data analysed. In addition to this, the modelled region may include parking regions that appear empty (or unoccupied) because no parking events have been detected, but nonetheless are predicted to contain parked vehicles (without devices), due to their proximity to the regions in which parking events have been monitored. A more accurate estimate of the total occupancy of the parking lot may hence be determined which accounts for missing probe data by using knowledge of typical parking trends, rather than simply by assuming an average number of devices per vehicle. Estimating the occupancy of the parking lot based on the number of parking regions could preferably include calculating the number of parking regions inside or outside of the modelled region, and/or calculating the ratio of the area of the lot covered by the modelled region, for instance, since this ratio is still typically based on the number of parking regions within the modelled region.

Outputting an estimate of the occupancy of the parking lot preferably comprises outputting the number of occupied and/or available parking spaces in said parking lot. Alternatively, or in addition, the ratio of occupied to available parking spaces, the percentage of occupied spaces, or broad occupancy indicators such as colour coded labels could be outputted. Furthermore, a particular benefit is realised wherein outputting an estimate of the occupancy of the parking lot further comprises outputting the estimate to a map database. By uploading this occupancy information to a map database, drivers may be able to access the occupancy information concerning a parking lot in advance of reaching that lot by using a portable device (such as a PND) that has access to the database via a network.

In accordance with a second aspect of the invention, there is provided computer readable optionally non-transitory, wherein the computer readable medium comprises instructions which when executed by one or more processors of a computing apparatus causes the computing apparatus to operate in accordance with the method of the first aspect of the invention.

In accordance with a third aspect of the invention, there is provided computing apparatus comprising:

one or more processors;

a receiver configured to receive, via a network to which the apparatus is coupled, probe data transmitted from a plurality of portable devices within a parking lot, wherein said probe data indicates the position of each device; and memory comprising map data indicating the geometry of a parking lot; and instructions which when executed by one or more of the processors causes the apparatus to perform the method of the first aspect of the invention.

BRIEF DESCRIPTION OF THE DRAWINGS

Examples of the invention are now described with reference to the accompanying drawings, in which.

DETAILED DESCRIPTION

Embodiments of the present invention will now be described with reference to a device that is configured to transmit probe data indicating the position of the device. This positional data may be obtained, for example, from GPS signal reception (if available). Alternatively, if the device is a mobile telephone not equipped with a GPS receiver, a more approximate estimation of the position of that device can be obtained from multilateration or triangulation of radio signals sent between radio towers of the cellular network and the device.

Figure 1:
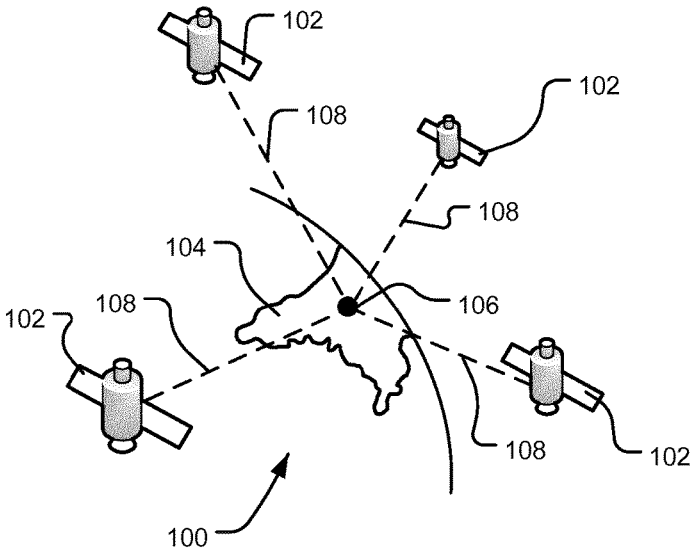
FIG. 1 is an illustration of a Global Positioning System (GPS)

The Global Positioning System (GPS) of FIG. 1 and the like are used for a variety of purposes. In general, the GPS is a satellite-radio based navigation system capable of determining continuous position, velocity, time, and in some instances direction information for an unlimited number of users. Formerly known as NAVSTAR, the GPS incorporates a plurality of satellites which orbit the earth in extremely precise orbits. Based on these precise orbits, GPS satellites can relay their location, as GPS data, to any number of receiving units. However, it will be understood that Global Positioning systems could be used, such as GLOSNASS, the European Galileo positioning system, COMPASS positioning system or IRNSS (Indian Regional Navigational Satellite System).

The GPS system is implemented when a device, specially equipped to receive GPS data, begins scanning radio frequencies for GPS satellite signals. Upon receiving a radio signal from a GPS satellite, the device determines the precise location of that satellite via one of a plurality of different conventional methods. The device will continue scanning, in most instances, for signals until it has acquired at least three different satellite signals (noting that position is not normally, but can be determined, with only two signals using other triangulation techniques). Implementing geometric triangulation, the receiver utilizes the three known positions to determine its own two-dimensional position relative to the satellites. This can be done in a known manner. Additionally, acquiring a fourth satellite signal allows the receiving device to calculate its three dimensional position by the same geometrical calculation in a known manner. The position and velocity data can be updated in real time on a continuous basis by an unlimited number of users.

As shown in FIG. 1, the GPS system 100 comprises a plurality of satellites 102 orbiting about the earth 104. A GPS receiver 106 receives GPS data as spread spectrum GPS satellite data signals 108 from a number of the plurality of satellites 102. The spread spectrum data signals 108 are continuously transmitted from each satellite 102. The spread spectrum data signals 108 transmitted each comprise a data stream including information identifying a particular satellite 102 from which the data stream originates, orbit data and high precision time information which is synchronised with each of the other satellites. The signals from the four satellites 102 in FIG. 1 allow the GPS receiver 106 to calculate the three-dimensional position of the GPS receiver 106.

Figure 2:
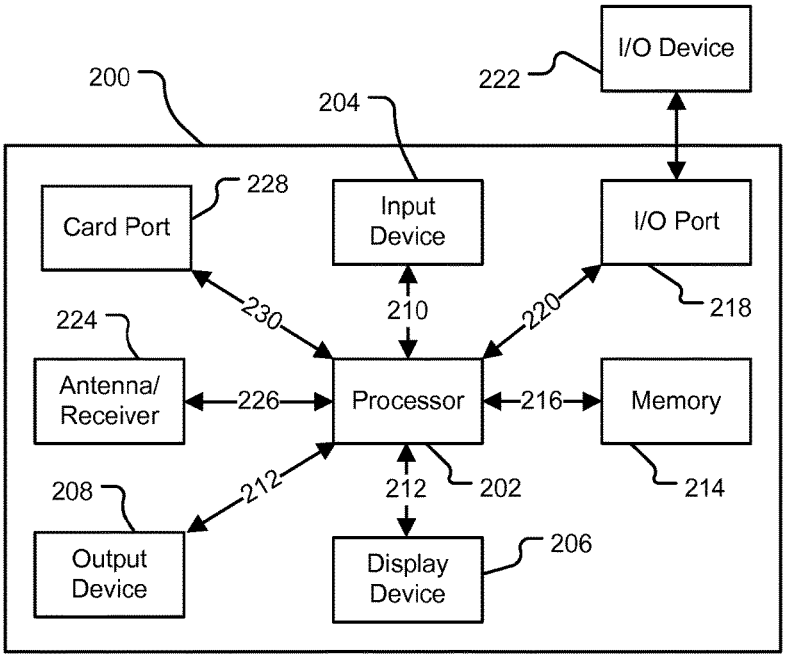
FIG. 2 is an illustration of a portable navigation device (PND)

An exemplary portable device for transmitting probe data is shown by the portable navigation device (PND) 200 of FIG. 2. PNDs are electronic devices that are configured to provide navigational instructions to a user based on respective positional data and information stored on a map database. In alternative embodiments, the portable device is not necessarily a navigational device (or PND) as it is not necessary to actually be able to relay navigational instructions to a user, so long as the device may transmit probe data indicating its position. For instance, a smartphone configured to emit GPS data could be used, without the need for a mapping application to actually be installed or activated. Alternatively the portable device may be an integrated black box unit in a vehicle and not actually contain any input devices for a user to interact with, provided that it emits probe data.

It should be noted that the block diagram of the PND 200 shown in FIG. 2 is not inclusive of all components of the portable device, but is only representative of many example components. The device 200 is located within a housing (not shown) and includes processing circuitry comprising, for example, the processor 202 mentioned above, the processor 202 being coupled to an input device 204 and a display device, for example a display screen 206. Although reference is made here to the input device 204 in the singular, the skilled person should appreciate that the input device 204 represents any number of input devices, including a keyboard device, voice input device, touch panel/screen and/or any other known input device utilised to input information. Likewise, the display screen 206 can include any type of display screen such as a Liquid Crystal Display (LCD), for example.

In one arrangement, the input device 204 and the display screen 206 are integrated so as to provide an integrated input and display device, including a touchpad or touchscreen input to enable both input of information (via direct input, menu selection, etc.) and display of information through the touch panel screen so that a user need only touch a portion of the display screen to select one of a plurality of display choices or to activate one of a plurality of virtual or "soft" buttons. In this respect, the processor 202 supports a Graphical User Interface (GUI) that operates in conjunction with the touchscreen.

In the PND 200, the processor 202 is operatively connected to and capable of receiving input information from input device 204 via a connection 210, and operatively connected to at least one of the display screen 206 and an output device 208, via respective output connections 212, to output information thereto. The output device 208 may be an audible output device (e.g. a loudspeaker). As the output device 208 can produce audible information for a user of the portable navigation device 200, it should equally be understood that input device 204 can include a microphone and software for receiving input voice commands as well. Further, the portable navigation device 200 can also include any additional input device 204 and/or any additional output device 208, such as audio input/output devices for example.

The processor 202 is operatively connected to memory 214 via connection 216 and is further adapted to receive/send information from/to input/output (I/O) ports 218 via connection 220, wherein the I/O port 218 is connectible to an I/O device 222 external to the portable navigation device 200. The external I/O device 222 may include, but is not limited to an external listening device, such as an earpiece for example. The connection to I/O device 222 can further be a wired or wireless connection to any other external device such as a car stereo unit for hands-free operation and/or for voice activated operation for example, for connection to an earpiece or headphones, and/or for connection to a mobile telephone for example, wherein the mobile telephone connection can be used to establish a data connection between the portable navigation device 200 and the Internet or any other network 9 for example, and/or to establish a connection to a server 10 via the Internet or some other network for example.

The memory 214 of the portable navigation device 200 comprises a portion of non-volatile memory (for example to store program code) and a portion of volatile memory (for example to store data as the program code is executed). The portable device also comprises a port, in this case a card port 228, which communicates with the processor 202 via connection 230, to allow a removable memory card (commonly referred to as a card) to be added to the device 200.

FIG. 2 further illustrates an operative connection between the processor 202 and an antenna/receiver 224 via connection 226, wherein the antenna/receiver 224 can be a GPS antenna/receiver for example and as such would function as the GPS receiver 106 of FIG. 1. It should be understood that the antenna and receiver designated by reference numeral 224 are combined schematically for illustration, but that the antenna and receiver may be separately located components, and that the antenna may be a GPS patch antenna or helical antenna.

It will, of course, be understood by one of ordinary skill in the art that the electronic components shown in FIG. 2 are powered by one or more power sources (not shown) in a conventional manner. Such power sources may include an internal battery and/or an input for a low voltage DC supply or any other suitable arrangement. As will be understood by one of ordinary skill in the art, different configurations of the components shown in FIG. 2 are contemplated. For example, the components shown in FIG. 2 may be in communication with one another via wired and/or wireless connections and the like. Thus, the Portable navigation device 200 described herein can be a portable or handheld navigation device.

Figure 3:
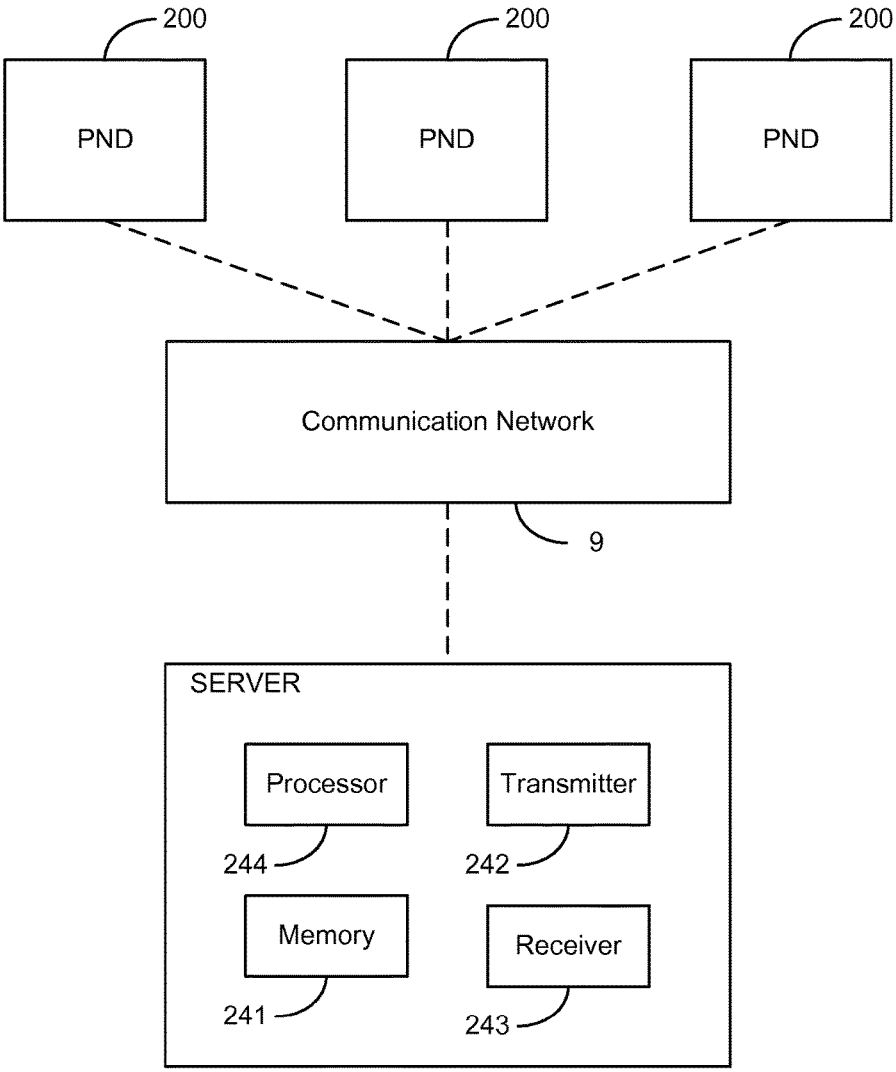
FIG. 3 is an illustration of a network for transmitting and receiving probe data.
Figure 4:
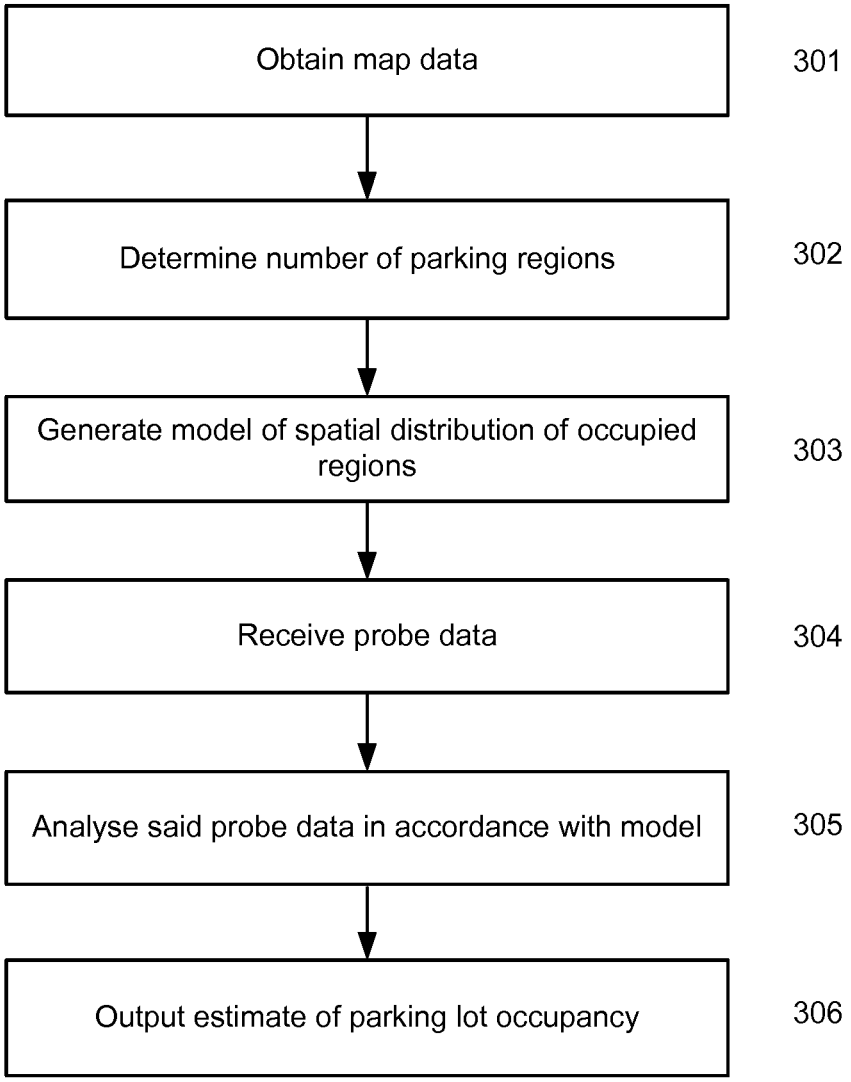
FIG. 4 is a flow diagram illustrating a method in accordance with an example of the invention.

An example of a network for receiving probe data in accordance with an example of the invention will now be described with reference to FIG. 3. Positional data, obtained from a GPS system, is time stamped and periodically transmitted by a plurality of PNDs 200 as probe data across a communication network 9 having a wireless part, such as provided by a 4G LTE or 3G cellular network, to a server 10. The server 10 may comprise one or more processors 244 and a receiver 243, configured to receive probe data via the communication network 9. Map data may be preinstalled onto memory 241 of the server 10 or accessed via the network 9 which may include the Internet (or potentially another input device). The memory 241 further comprises instructions which when executed by one or more of the processors 244 causes the server to estimate the occupancy of a parking lot in accordance with an example of the invention to be described.

Figure 5:
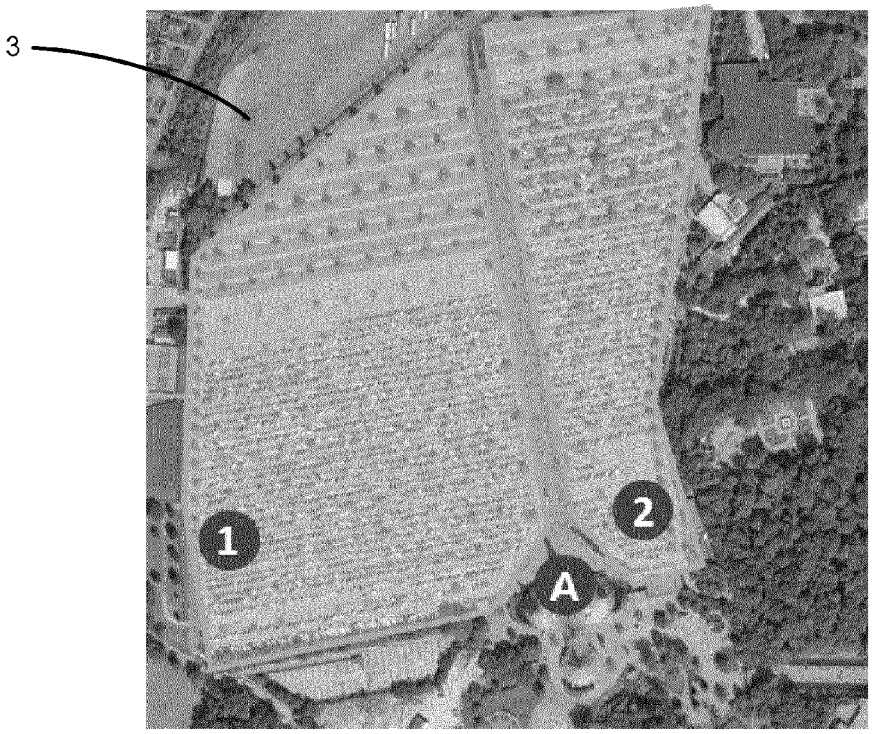
FIG. 5 is an illustration of map data obtained in accordance with an example of the invention.

An exemplary method for performing the invention will now be described with reference to FIGS. 2 to 10. The method begins at step 301 of FIG. 4 whereby map data indicating the geometry of the parking lot is obtained. In this example a satellite image 3 of a large single story car park is used, as shown by FIG. 5. The image 3 is analysed by a user and geometric coordinates indicating the boundaries of the parking lot are identified from the image 3. Alternatively, a shape fitting algorithm may be used to perform this lot identification procedure. If the map data is alternatively obtained from a mapping or surveying organisation such as Ordnance Survey then such data is more readily analysed using an automated approach.

In addition to boundary identification, in the present example reference locations, such as entrances or exits to the parking lot, are manually identified from the image 3 stored as map data on the memory 241 of the server 10. Furthermore, parking areas within the parking lot may be defined using additional "internal" boundaries within the parking lot. In this example, the parking lot consists of the areas 1 and 2 shown in FIG. 5 (each of which may be defined using internal boundaries), with a common entry and exit point of the parking lot labelled A. If the GPS coordinates outlining the boundary of the parking lot (and potentially any reference locations, such as entry and exit points and any internal boundaries) are known in advance these could alternatively be directly inputted to a computing apparatus without the need for an image 3.

Figure 6:
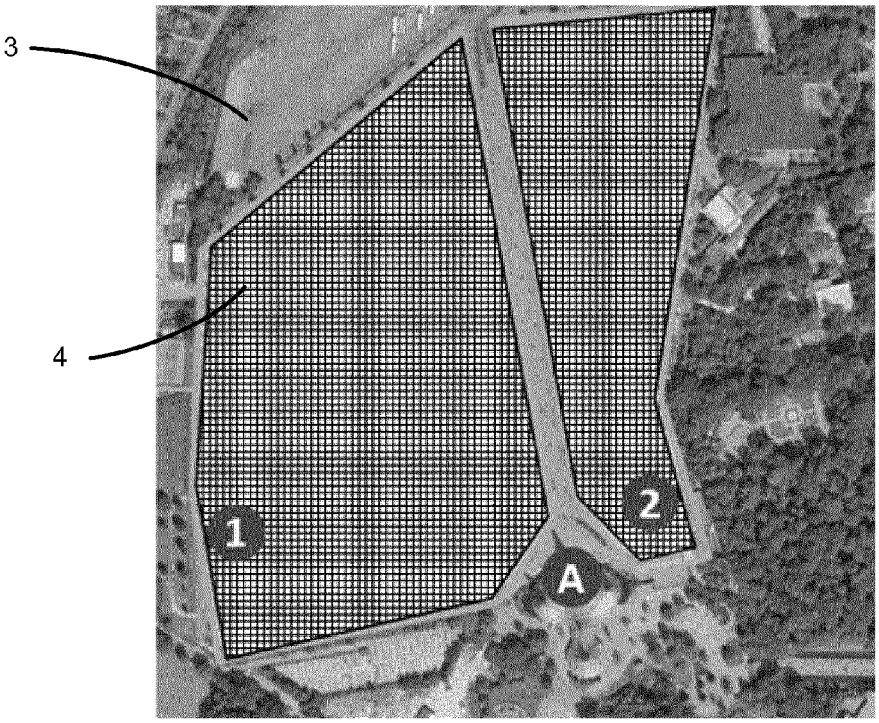
FIG. 6 is an illustration of a parking lot in which parking regions have been determined.

The number of parking regions within the parking lot is determined at step 302. An example of this is shown in FIG. 6 whereby a regular grid 4 of parking areas is overlaid onto areas 1 and 2 of the parking lot so as to include any areas where vehicles may park. The central lane shown between the regions 1 and 2 is excluded from the grid 4 as it does not contain any parking spaces. It is preferable that each "tile" or box within the grid 4 corresponds to an individual parking space within the lot. As will be appreciated the use of regions which are smaller than parking spaces provides no additional benefit. Alternatively however a plurality of parking spaces may share a given parking region (as is the case in FIG. 6). In countries where there is a low usage of portable devices that emit probe data, such as PNDs, it may be desirable to have larger parking regions in order to increase the likelihood of receiving probe data emitted from within a given parking region. This does however reduce the accuracy of the output data. Where device usage is sufficiently high, in order to most accurately map the density of devices 200 across the parking lot, it is preferable that each parking region corresponds directly with the area of a respective parking space. The surface markings of each parking space may be automatically or manually identified from the satellite image 3 and the respective positional coordinates entered as parking regions to be analysed for the presence of probe data. In the example shown in FIG. 6, however, a more approximate estimation is instead obtained by simply overlaying a grid 4 whereby the area of each region (or tile) within the grid approximates to the area of four parking spaces grouped together, although the actual outer position of the parking spaces does not necessarily coincide with that of each region of the grid.

A model of the spatial distribution of occupied regions is generated at step 303. In this example the model is generated based on historical probe data collected over a modelling period; namely the months of March and July 2012. The historical probe data may be obtained from a number of sources including mobile telephone operators and organisations providing navigational services. Such probe data provides an extensive amount of information and is statistically sufficient to enable analysis of the parking behaviour of vehicles in terms of where the parking activity occurs at different levels of occupancy of the parking lot as a whole. This enables the generation of a model of where parking will occur in the parking lot at different levels of lot occupancy. For example with an empty parking lot, vehicles entering the lot will park in the most preferred parking spaces, whereas vehicles entering a parking lot that is already approaching its maximum occupancy capacity will on average park in a limited region with a relatively small number of available spaces, these being the least preferred by the previous vehicles to arrive (perhaps because they are the areas which are most inconveniently positioned).

The historical probe data contains the positional information for each device 200 within the lot and is typically emitted every five or ten seconds by the devices 200. It is this recorded data which is obtained from the organisations mentioned earlier for use in the analysis of parking behaviours. If the data is not available or not desired to be obtained from other sources the data may be received by the server 10 via the communication network 9 over a data acquisition period, which may be a few weeks in length. As will be appreciated, the probe data included devices in vehicles which have entered the parking lot and are in motion looking for a parking space, together with those which are in motion exiting the parking lot. The probe data of particular interest for the model is that which relates to devices in vehicles which are within a parking space.

Regardless of how the probe data is obtained for generating the model the probe data for the period in question is mapped onto the grid 4 so as to produce a density map of probe data received from within the parking lot within a particular time period. This is achieved using the approach now discussed.

A given parking region is determined to be occupied if a threshold amount of probe data is received having coordinates within that region over a short period of time referred to as a parking period. In this example probe data signals are emitted every ten seconds by devices 200 and a parking region is identified as being occupied if a threshold number of at least three signals have been received over a thirty second parking period. This short temporal window may be chosen so as to retrieve the maximum amount of data from parked vehicles and exclude signals received from vehicles that are in transit or have only momentarily paused, from being identified as occupying a parking region. Consideration may also be given to the length of time in which a device 200 will typically continue emitting probe data from within the parking region, once the vehicle is parked, before it is either powered off, or removed from the region by the occupants of the vehicle departing on foot with the device 200. The parking period may therefore typically range between ten and sixty seconds.

It is not necessary to distinguish between probe data received from different devices 200 as the data received may be anonymised such that the time stamped positioned coordinates of the device 200 is all that is available to the server 10. Hence in the case that a thirty second parking period is chosen, it may be determined that a parking region is occupied if a first device occupying the region emits probe data from within the region for twenty seconds, whilst a second device emits probe data from within the same region for the subsequent ten seconds. Alternatively the region may be said to be occupied if a plurality of devices occupy that region for at least thirty seconds at the same time. The precise choice of period depends on the average amount of time for which a PND will remain transmitting probe data after the vehicle has been parked, or for which a vehicle occupant will remain with a parked vehicle.

By using a relatively long modelling period, for example over a week (and in this case one month), a large amount of probe data can be received so that each region that is typically occupied in real life by a vehicle will likely be identified as being 'occupied' at some stage during the modelling period due to probe data having been received with positional coordinates corresponding to that region.

Figure 7:
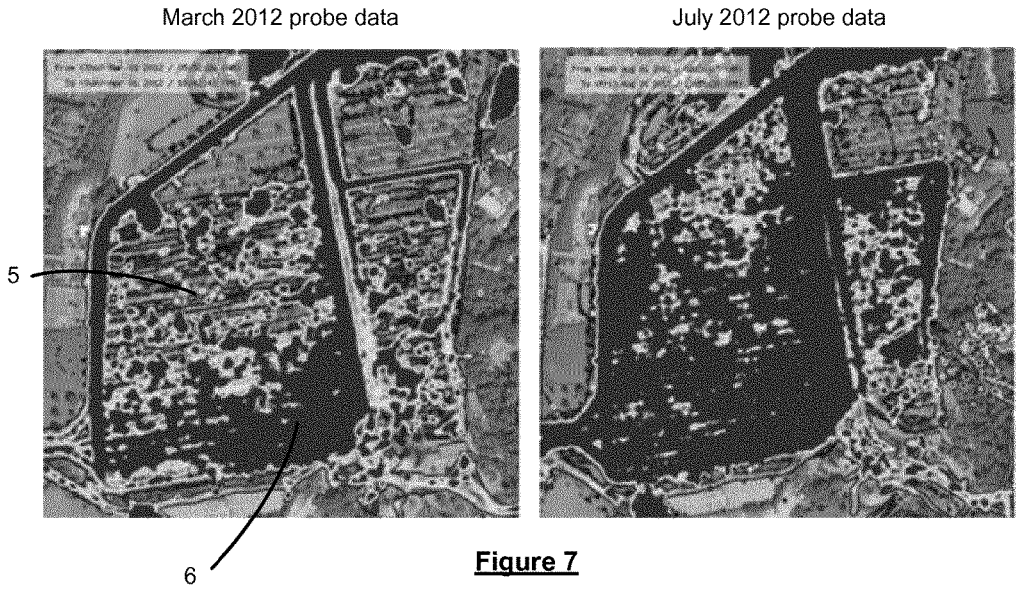
FIGS. 7 and 8 are illustrations of probe data received from a parking lot.
Figure 8:
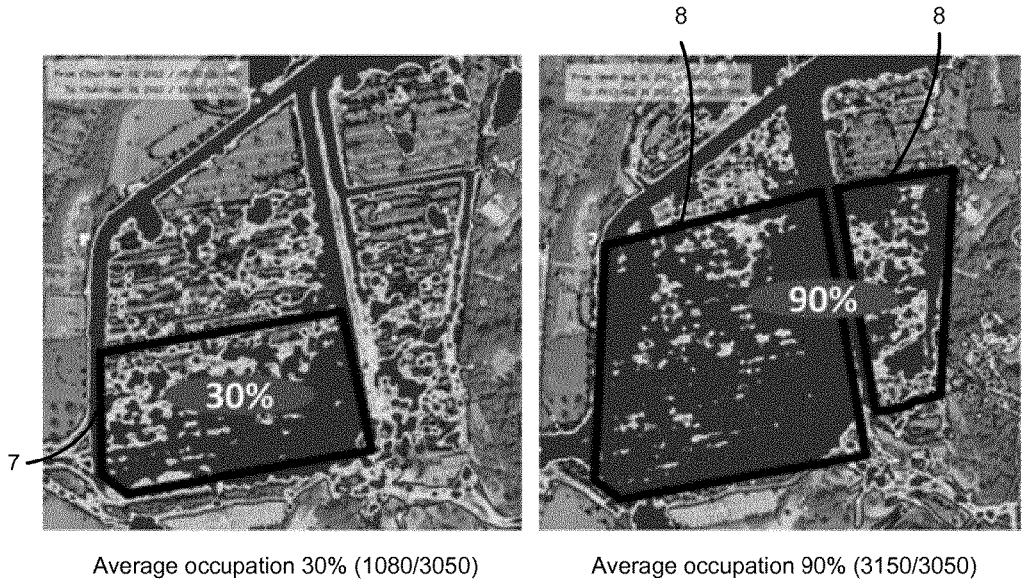

The darker areas 6 in FIG. 7 show regions with higher instances of occupation during the modelling period, whilst the regions which tended to have lower occupancy or be unoccupied are shown by the lighter areas 5. For example the March 2012 data shows high instances of occupation for about 30% of the parking regions, whereas for the July 2012 data about 90% of the parking regions exhibited high occupancy. By analysing the probe data received over these two modelling periods it may be determined that ringed regions 7 shown in FIG. 8 are typically occupied when the car park is 30 percent full and that the ringed regions 8 are typically occupied when the car park is 90 percent occupied. Hence the average occupancy levels of the car park over a long period such as a month can be related to how the car park is occupied as it fills on a particular day. Thus, using this principle, an occupancy model for the spatial distribution of occupied parking regions, as a function of the total number of parking regions (i.e. how the car park fills up), may be generated in accordance with FIG. 9. In this model, it is deduced from the probe data obtained over the modelling period that drivers would rather park their vehicles close to the reference location A, which in this case is the entry and exit point. The progressive occupation of parking regions/spaces as the car park fills will then extend in the direction shown by the upward arrow in FIG. 9, along the central lane and away from the reference location A as additional vehicles occupy the lot. There may be instances whereby certain drivers choose to park as far away from other parked cars as possible (for example) and so probe data received from these vehicles may not fit the trend suggested by this simplistic model. These results can be excluded on a statistical basis, depending on the level of sophistication of the model. The model accuracy is of course improved if more data is used (for example from different months) which shows other levels of average occupancy (such as 50% or 75% for example).

In more complex models a plurality of reference locations may be identified from either the map data and/or the probe data received during the modelling period. Furthermore, the probe data received over the modelling period may be supplemented by actual onsite measurements taken from the number of vehicles entering and exiting the car park over the modelling period in order to improve the quality of the model generated. The direction of the 'filling' of the lot may also be determined by machine learning, rather than by manual intervention.

If sufficient data is available over an extensive period then by making an assumption that the parking lot is empty at a time such as 3 AM every day, the daily filling and emptying of the parking lot may be analysed by monitoring how the distribution of regions which are classified as "occupied" from the probe data (such as three time stamped signals within a region) change during a day. For example it is to be expected that, in the case of the parking lot shown in FIGS. 7 and 8 that a locus of occupied spaces may be observed to propagate away from the reference point A, the locus of spaces forming a line parallel to the lowermost fence in FIGS. 5 to 8, as the parking lot fills. The boundary between assumed occupied and assumed unoccupied spaces at any point in time may be deduced from looking at statistically significant clusters of "parking events" (parking regions becoming occupied) in a short time window containing that point in time and which occur at the furthest locations from reference point A for example. This statistical approach is particularly suited to machine learning techniques.

Alternatively, an appropriate model may be chosen by best-fit matching with a number of predetermined occupation models, possibly after having identified reference locations such as pay meters, entry/exit points or shop entrances from the map data.

Figure 9:
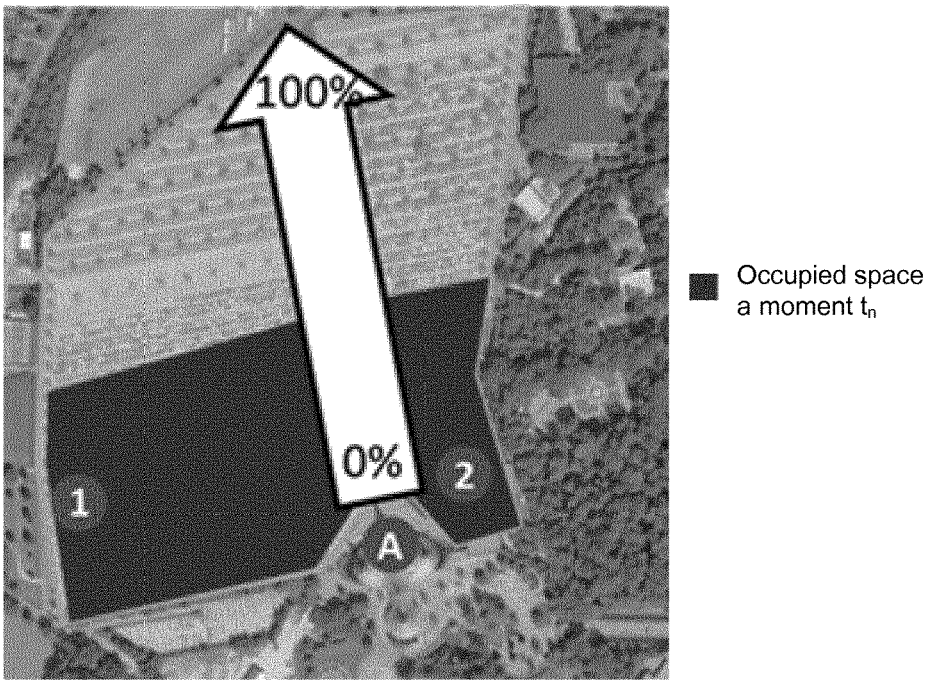
FIG. 9 is an illustration of a model generated in accordance with an example of the invention.

Returning to the present example, the model generated from the information shown in FIG. 9 is essentially one of a linear filling of the parking lot away from the reference point A. Having established this model it may then be used in predicting the occupancy of the parking lot using a much smaller set of probe data obtained over a "sampling period" of interest, which may represent a time in the past or the real time occupancy. This is performed at steps 304 and 305.

Sample probe data corresponding to a sampling period is received by computing apparatus, in this case server 10, at step 304, from a plurality of portable devices 200 connected to the network 9. In the example shown by FIG. 10, probe data is received over a sampling period of one hour. The sampling period is typically shorter than the modelling period in order to provide an estimate of the occupancy of the parking lot at a given time (or within a given time period) only. There is no need to monitor the direction of 'flow' of occupied spaces during this time. The sampling period is typically between five and sixty minutes but can in principle be as short as the period of time required to determine if a region is occupied; i.e. the parking period (such as thirty seconds), although much greater accuracy is achieved using longer periods and/or data for large parking lots.

The sample probe data is then analysed at step 305 in accordance with the model previously generated in order to estimate which parking regions are occupied at least once during the sample period. Once again, a region is defined as occupied if a threshold number of time stamped coordinates has been received from within that region over a parking period. In this example, if such a parking event is monitored at least once during the sampling period for a given parking region, that region is assumed to be occupied for the duration of the sampling period. More sophisticated approaches which account for the length of time in which a parking region is identified as being occupied according to the probe data are also envisaged however. The total occupancy of the parking lot is then calculated in accordance with the spatial distribution of the occupied regions and the generated model.

In practice only a minority of occupied parking spaces or regions will contain a vehicle equipped with a device 200 configured to emit probe data. This may increase in the future to become a majority as probe data emitting devices increase in use. Since vehicles tend to park together in clusters (as previously described), it can be assumed that parking regions that are close to regions identified as occupied from the probe data are likely to also be occupied by vehicles in reality. By analysing the geographical spread of occupied regions and by comparing this to a spatial distribution predicted by the model, one can estimate the extent to which the parking lot is occupied.

Figure 10:
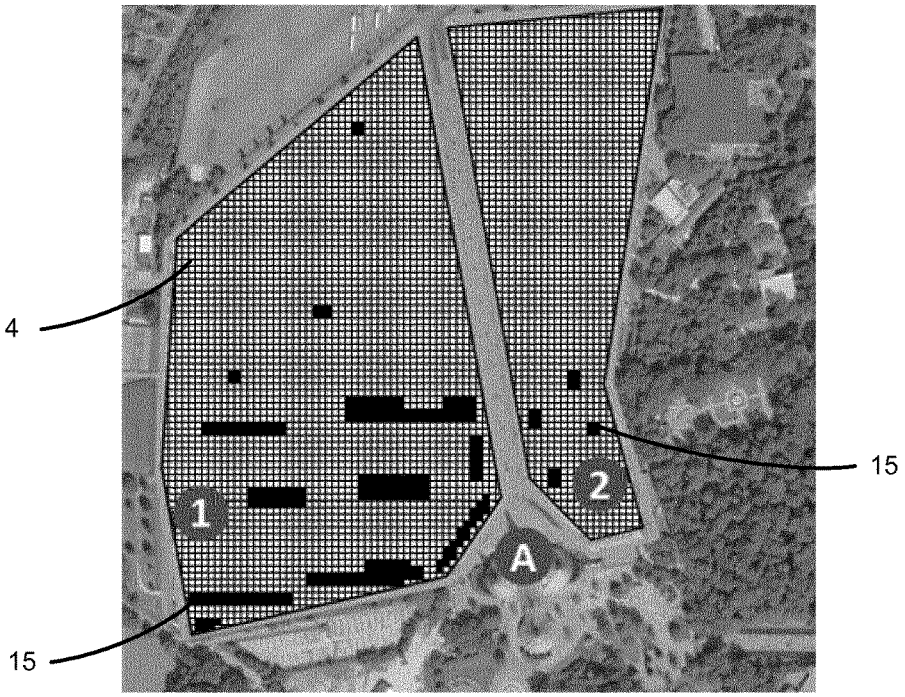
FIG. 10 is an illustration of probe data received and analysed in accordance with an example of the invention.

An example of this is shown by FIG. 10 whereby regions identified as being occupied during the sample period in accordance with received probe data are shaded in. A modelled region 15 that outlines the boundary of a determined spread of occupied regions is also shown. The modelled region 15 matches the model shown in FIG. 9 in that it extends away from the reference location A in a linear manner in the direction of the central lane. According to the model, the whole of the modelled region 15 contains occupied parking spaces, even though a number of unshaded parking regions inside this region 15 appear empty or unoccupied according to the analysed probe data (due to an insufficient amount of probe data having been received during the sampling period with positional coordinates corresponding to that region). A number of occupied parking regions, shown in black, that are outside of the ringed areas 15 can also be seen in FIG. 10. These results can be ignored as statistical noise since they are sufficiently far removed from the cluster outlined by the modelled region 15 and do not fit the model. Alternatively it could be assumed that the number of occupied regions outside of the modelled region 15 broadly match the number of unoccupied regions that have nonetheless been included into the modelled region 15. By calculating the extent to which the modelled region 15 covers the area of the parking lot, or by calculating the number of parking regions within said modelled region 15, one can estimate the overall occupancy of the parking lot.

An estimate of the occupancy of the parking lot is then output at step 306. This estimate may, for example, indicate the percentage of occupied or available parking spaces, or the total number of occupied and/or available parking spaces within the lot, depending on the accuracy of the data and the model. In the example shown by FIG. 9 it is determined that the parking lot is approximately 25 present occupied. We note here that this may be determined even though the original historical probe data upon which the model was generated included a minimum 30% occupancy (in the case of the March 2012 data).

The parking lot occupancy information may be uploaded to a map database to which a plurality of PNDs 200 are coupled in order to provide assistance to drivers attempting to find available parking spaces, or may be stored for later use in order to analyse trends in how busy a particular parking lot was over a given period of time. It may be otherwise used in smartphone applications which for example could guide vehicles to nearby parking lots with available spaces.

Since the software or computer readable medium required to execute the above method be readily and inexpensively downloaded, the costs in obtaining this occupancy data can be drastically reduced, if compared to physical sensors for example. Furthermore, this occupancy data can hence be obtained by third parties that do not own or operate the parking lot.

The invention claimed is:

1. A method for estimating, by a server computing device that includes a processor and a receiver, the occupancy of a parking lot, the method comprising:

obtaining, by the server computing device, map data indicating the geometry of a parking lot;

determining, by the server computing device, a number of parking regions within said parking lot using said map data;

generating, by the server computing device, a model of the spatial distribution of occupied parking regions as a function of the total number of occupied parking regions within the parking lot, the generating comprising acquiring first probe data during a modelling time period and, based on an analysis of occupancy of the parking regions as indicated by the first probe data during the modelling time period, determining the model of the spatial distribution of occupied parking regions;

receiving, by the server computing device, second probe data from a plurality of portable devices within said parking lot, wherein said second probe data indicates the position of each device, and analyzing, by the server computing device, said second probe data in accordance with said model and outputting, by the server computing device, an estimate of the occupancy of the parking lot.

2. The method according to claim 1, wherein said model provides an estimate of which parking regions will be occupied as the overall occupancy of the parking lot changes.

3. The method according to claim 1, wherein said model is generated based on the geometry of the parking lot and a reference location obtained from said map data, wherein said reference location indicates a preferred parking area.

4. The method according to claim 1, wherein determining the model of the spatial distribution of occupied parking regions comprises:

determining which regions of the parking lot are occupied based on the spatial density of the first probe data during the modelling period; and estimating the total occupancy of the parking lot based on the spatial distribution of occupied regions.

5. The method according to claim 1, wherein said first probe data comprises time-stamped positional coordinates and wherein a region is determined to be occupied if the number of coordinates received from within said region with time stamps corresponding to a parking period exceeds a threshold number.

6. The method according to claim 1, wherein each region corresponds to a single parking space.

7. The method according to claim 1, wherein estimating the occupancy of the parking lot based on the model of the spatial distribution of occupied parking regions as a function of the total number of occupied parking regions within the parking lot further comprises:

generating a modelled region in which a spatial distribution of occupied regions analyzed in accordance with the model indicate that the modelled region is occupied; and estimating the occupancy of the parking lot based on the number of parking regions within said modelled region.

8. The method according to claim 1, wherein outputting an estimate of the occupancy of the parking lot comprises outputting the number of occupied and/or available parking spaces in said parking lot.

9. The method according to claim 1, wherein outputting an estimate of the occupancy of the parking lot further comprises outputting said estimate to a map database.

10. A non-transitory computer readable medium comprising, instructions which, when executed by one or more processors of a computing apparatus, causes the computing apparatus perform a method comprising:

obtaining map data indicating the geometry of a parking lot;

determining a number of parking regions within said parking lot using said map data;

generating a model of the spatial distribution of occupied parking regions as a function of the total number of occupied parking regions within the parking lot, the generating comprising acquiring first probe data during a modelling time period and, based on an analysis of occupancy of the parking regions as indicated by the first probe data during the modelling time period, determining the model of the spatial distribution of occupied parking regions;

receiving second probe data from a plurality of portable devices within said parking lot, wherein said second probe data indicates the position of each device, and analyzing said second probe data in accordance with said model and outputting an estimate of the occupancy of the parking lot.

11. The non-transitory computer readable medium according to claim 10, wherein said model provides an estimate of which parking regions will be occupied as the overall occupancy of the parking lot changes.

12. The non-transitory computer readable medium according to claim 10, wherein said model is generated based on the geometry of the parking lot and a reference location obtained from said map data, wherein said reference location indicates a preferred parking area.

13. The non-transitory computer readable medium according to claim 10, wherein determining the model of the spatial distribution of occupied parking regions comprises:

determining which regions of the parking lot are occupied based on the spatial density of the first probe data during the modelling period; and estimating the total occupancy of the parking lot based on the spatial distribution of occupied regions.

14. The non-transitory computer readable medium according to claim 10, wherein estimating the occupancy of the parking lot based on the model of the spatial distribution of occupied parking regions as a function of the total number of occupied parking regions within the parking lot further comprises:

generating a modelled region in which a spatial distribution of occupied regions analyzed in accordance with the model indicate that the modelled region is occupied; and estimating the occupancy of the parking lot based on the number of parking regions within said modelled region.

15. A computing apparatus comprising:

one or more processors;

a receiver configured to receive, via a network to which the apparatus is coupled, probe data transmitted from a plurality of portable devices within a parking lot, wherein said probe data indicates the position of each device; and memory comprising map data indicating the geometry of a parking lot and instructions which when executed by one or more of the processors causes the apparatus to perform a method comprising:

obtaining map data indicating the geometry of a parking lot;

determining a number of parking regions within said parking lot using said map data;

generating a model of the spatial distribution of occupied parking regions as a function of the total number of occupied parking regions within the parking lot, the generating comprising acquiring first probe data during a modelling time period and, based on an analysis of occupancy of the parking regions as indicated by the first probe data during the modelling time period, determining the model of the spatial distribution of occupied parking regions;

receiving second probe data from a plurality of portable devices within said parking lot, wherein said second probe data indicates the position of each device, and analyzing said second probe data in accordance with said model and outputting an estimate of the occupancy of the parking lot.

16. The computing apparatus according to claim 15, wherein said model provides an estimate of which parking regions will be occupied as the overall occupancy of the parking lot changes.

17. The computing apparatus according to claim 15, wherein said model is generated based on the geometry of the parking lot and a reference location obtained from said map data, wherein said reference location indicates a preferred parking area.

18. The computing apparatus according to claim 15, wherein determining the model of the spatial distribution of occupied parking regions comprises:

determining which regions of the parking lot are occupied based on the spatial density of the first probe data during the modelling period; and estimating the total occupancy of the parking lot based on the spatial distribution of occupied regions.

19. The computing apparatus according to claim 15, wherein estimating the occupancy of the parking lot based on the model of the spatial distribution of occupied parking regions as a function of the total number of occupied parking regions within the parking lot further comprises:

generating a modelled region in which a spatial distribution of occupied regions analyzed in accordance with the model indicate that the modelled region is occupied; and estimating the occupancy of the parking lot based on the number of parking regions within said modelled region.

* * * * *